United States Patent [19]

Venot

[11] 4,047,374

[45] Sept. 13, 1977

[54] FALSE TWIST TEXTURIZING SPINDLE

[75] Inventor: Jean Venot, Roanne, France

[73] Assignee: ASA S.A., Roanne, France

[21] Appl. No.: 742,099

[22] Filed: Nov. 16, 1976

[30] Foreign Application Priority Data

Nov. 19, 1975 France ..... 75.36070

[51] Int. Cl.[2] ..... D02G 1/04

[52] U.S. Cl. ..... 57/77.45; 57/77.4; 57/92; 74/221

[58] Field of Search ..... 57/19, 34 R, 77.3, 77.33, 57/77.35, 77.4, 77.45, 78, 88, 89, 92, 104, 105; 74/213, 221

[56] References Cited

U.S. PATENT DOCUMENTS

| | | | |
|---|---|---|---|
| 2,478,928 | 8/1949 | Carter et al. | 57/89 |
| 3,115,743 | 12/1963 | Brodtmann | 57/77.45 |
| 3,224,180 | 12/1965 | Graf | 57/88 |
| 3,345,811 | 10/1967 | Gilchrist | 57/77.4 X |
| 3,932,985 | 1/1976 | Scragg et al. | 57/77.45 |
| 3,940,914 | 3/1976 | Schuster | 57/77.4 |

FOREIGN PATENT DOCUMENTS

| | | | |
|---|---|---|---|
| 790,122 | 2/1958 | United Kingdom | 57/89 |
| 854,780 | 11/1960 | United Kingdom | 57/77.4 |

*Primary Examiner*—Donald Watkins
*Attorney, Agent, or Firm*—Arnold, White & Durkee

[57] ABSTRACT

A spindle adapted for mounting on the framework of a false twist texturizing machine. The spindle includes a platen having three bosses mounted perpendicularly thereon, the bosses being positioned on the platen to form a triangle. Friction discs are carried on the bosses and overlap one another to define a zig-zag path for the yarn. A two-piece fixed guide tube aligned with the center of the triangle formed by the bosses feeds the yarn into and out from the spindle. A motor pulley is mounted on a lever which pivotally attaches to the platen, the motor pulley being adapted to engage a tangential belt disposed adjacent the platen to impart rotary motion to the pulley. A belt drive interconnects the motor pulley with the bosses to rotate the same. A rod pivots the lever to engage or disengage the motor pulley with the tangential belt and control rotation of the bosses.

7 Claims, 3 Drawing Figures

FALSE TWIST TEXTURIZING SPINDLE

BACKGROUND OF THE INVENTION

1. Field of the Invention

The present invention relates to apparatus for placing a false twist in yarn; and more particularly, it relates to a texturizing spindle for imparting a false twist to yarn by parallel rotating discs.

2. Description of the Prior Art

False twist texturizing is a technique which is in itself well known and is widely used, and which basically involves overtwisting a thermoplastic yarn, fixing this deformation, and then untwisting the yarn by the amount that it has been twisted.

It has been known in the art to impart a false twist to a moving yarn by means of a disc, as disclosed in U.S. Pat. No. 1,030,179 to Hilden. It has also been proposed to use this concept in false twist texturizing. For this purpose, friction discs are spaced apart on revolving bosses which are substantially parallel, the discs overlapping from one shaft to another. Illustrative of this arrangement are French Pat. Nos. 1,202,393 and 1,255,922 to Scragg and 1,261,747 to Zavody.

In spindles having three bosses, which are currently the most widely used, it is known to arrange the three revolving bosses, which serve as shafts and carry the discs, in such a way that in a plan view the bosses form the apices of an equilateral triangle. With this arrangement, the yarn to be treated traverses the assembly by following a zig-zag path between the discs which overlap one another.

In order to introduce the yarn between the discs it is necessary first to disengage the spindle and then either individually to shift one shaft relative to the other two, as taught in French Pat. No. 1,203,072 to Hobourn, or to shift the three shafts equally, as taught in French Pat. Nos. 2,176,826 and 2,225,554 to Kugelfischer or in British Pat. No. 1,379,960 to Scragg. This produces a small rectilinear passage into which the yarn will be fed. Next, the spindle is engaged by bringing the three axles into their working position, with the discs overlapping one another.

Prior art spindles with three bosses, such as that illustrated in FIG. 1, essentially comprise a horizontal platen 1 having bosses 2 mounted perpendicularly thereon, each of which is equipped with a friction disc. The bosses 2 are interconnected and driven synchronously by a ridged belt 4 which passes over a motor pulley 3 mounted on the platen 1. The motor pulley 3 is caused to rotate by the tangential belt 6, with an adjustable pulley 7 regulating the tension of ridged belt 4. The platen 1 slides horizontally on two parallel guides 5.

When it is desired to engage the spindle, placing it in the operating position, it is only necessary to move the platen 1 in the direction of the arrow F1 so as to bring the motor pulley 3 into contact with the tangential belt 6. Pulley 3 is thus caused to rotate and, in turn, drives the bosses 2. To disengage the spindle, platen 1 is shifted in the opposite direction, as shown by the arrow F2, to move the motor pulley 3 away from the belt 6, causing the rotation of the pulley 3, and hence the rotation of the bosses 2, to stop.

Though this conventional assembly is widely used, it nevertheless suffers from the disadvantage of shifting the bosses during the engagement and disengagement operations. In effect, in spite of the rigid fixing of these bosses on the platen, the sliding of this component on guides necessarily requires a certain play in the assembled unit and this play is a source of vibrations which introduce irregularities in the twist and cause premature wear of the bearings. This shifting of the platen is furthermore objectionable because it results in two positions of the yarn.

SUMMARY OF THE INVENTION

Accordingly, it is a feature of the instant invention to provide a false twist spindle that keeps the bosses in a fixed position during all operations.

In accordance with the instant invention, a spindle for false twist texturizing comprising a fixed platen having a motor pulley mounted on an axle substantially perpendicular to the platen for engaging a tangential belt disposed adjacent the pulley, three bosses mounted on the platen parallel to the motor pulley, and a friction disc carried on each boss and caused to rotate synchronously with the motor pulley is characterized by the motor pulley being mounted on a lever which pivots about a vertical axle secured to the platen and means for causing the lever to pivot about the vertical axis. In operation, the motor pulley is caused to engage the tangential belt without movement of the platen.

More specifically, the bosses form in relation to one another the apices of a substantially equilateral triangle, so that the friction discs, when in the operating position, overlap so as to define a zig-zag path for the passage of the yarn.

The means for pivoting the lever about the vertical axle may preferably comprise a rod substantially parallel to the plane of the platen and able to slide in a seat mounted on the platen, of which the end possesses a drive dog which can move in a slot machined in the end of the lever.

BRIEF DESCRIPTION OF THE DRAWINGS

The manner in which the invention can be put into practice and the advantages which result therefrom will emerge more clearly from the illustrative embodiment which follows and is given, by way of indication and without implying a limitation, in connection with the attached figures wherein.

DETAILED DESCRIPTION OF A PREFERRED EMBODIMENT

A spindle in accordance with the invention is intended to be mounted on the framework of a false twist texturizing machine, preferably between the outlet of a first heat treatment oven and the second feeder. This type of machine is well known; therefore, it serves no purpose to describe it in detail here. In short, this machine comprises a plurality of parallel treatment positions located side by side and/or on one of the two faces of the machine, each position comprising a spindle. This spindle may be affixed in any appropriate manner to the framework of the machine.

Figure 1:
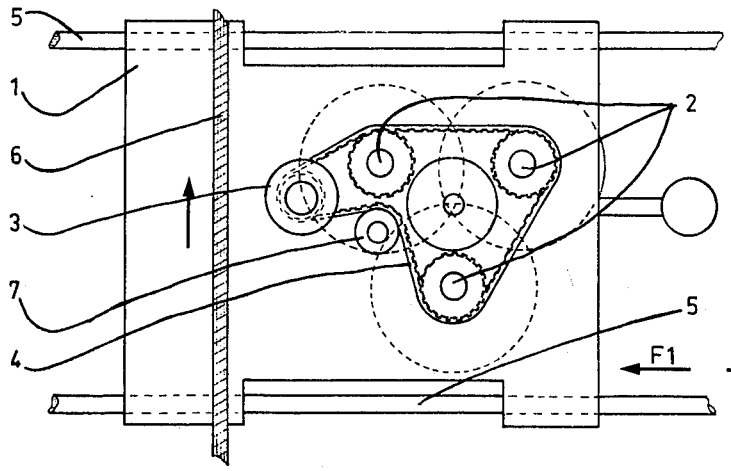
FIG. 1 is a view from below of a disc-type false twist texturizing spindle of a configuration well known in the art.
Figure 2:
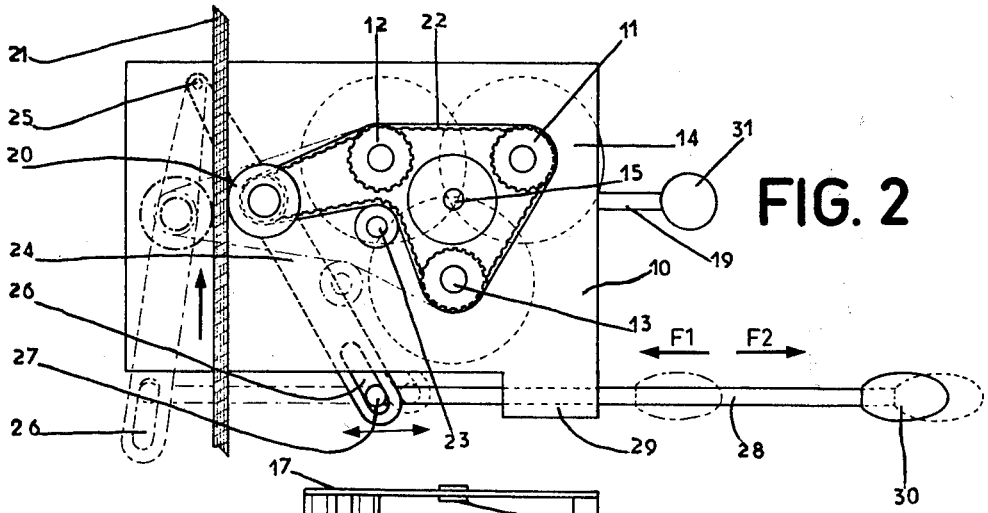
FIG. 2 is also a view from below of an improved spindle constructed in accordance with the instant invention.

Referring to FIG. 2, a spindle for use in a false twist texturizing machine, and in accordance with the instant invention is shown. The spindle has a horizontally disposed platen 10, constructed for example from cast iron.

Figure 3:
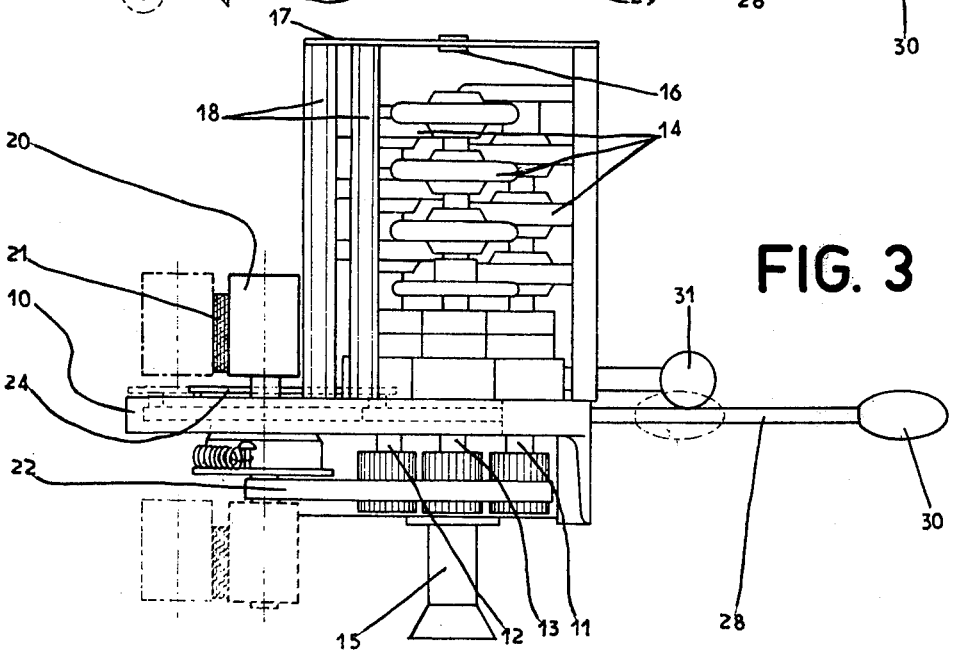
FIG. 3 is an elevation view of the spindle of FIG. 2.

Three bosses 11, 12 and 13 are arranged perpendicularly to the plane of the platen 10 and parallel to one another, with the projections of the bosses on the platen 10 forming between them the apices of a substantially equilateral triangle. These bosses 11, 12 and 13 carry gearwheels on their lower part, located below the platen 10; and on their upper part, located above the platen 10, they carry friction discs 14, for example made of steel, Vulcollan, ceramic or the like. The discs may be rounded, truncated or some other suitable shape, and either force-fitted, or free and detachable, on the shaft of the bosses. The friction discs 14 overlap one another, as shown in FIG. 3, so as to define a zig-zag path for the yarn. A device 19, such as that described in the abovementioned French Pat. Nos. 2,176,826 and 2,225,554 or British Pat. No. 1,379,960, is provided for moving the three bosses 11, 12 and 13 apart, in an identical manner, when introducing the yarn, so as to produce a small rectilinear passage for the yarn.

A tangential belt 21 common to several treatment stations is permanently driven in the direction of the arrow by a motor which is not shown, and passes close to the platen 10 in a plane substantially perpendicular to the plane of the latter. A motor pulley 20 is mounted on an axle perpendicular to the platen 10 and is adapted to rest against the tangential belt 21. A ridged belt 22 is provided to impart to the gearwheels of the bosses 11, 12 and 13 the rotary movement of the motor pulley 20. An adjustable-position pulley 23 enables the tension of the ridged belt 22 to be adjusted to a desired level.

The motor pulley 20 is mounted on a lever 24 which pivots about a vertical axle 25 firmly fixed to the platen 10 and located on the other side of the belt 21 relative to the pulley 20. The free end of this lever 24 has a slot 26 in which is seated a dog 27 fixed to the end of a rod 28 that slides in the horizontal plane of a seat 29 mounted on the platen 10. The free end of the rod 28 has a pommel 30.

The spindle also comprises a device 19 which can be maneuvered by means of the ball 31 and can articulate in a horizontal plane, and which is intended to move the three bosses 11, 12 and 13 apart.

Referring now to FIG. 3, a fixed guide tube 15, for example, made of metal, perpendicular to the platen 10 and located substantially in-line with the center point of the triangle formed by the bosses 11, 12 and 13 feeds the yarn to be treated. An outlet guide 16, also located in-line with the center point of the triangle, is placed on a horizontal plate 17 which is held by vertical rods 18.

Operation

When it is desired to engage the spindle, the pommel 30 is pressed, which shifts the rod 28 in the direction of the arrow F1, causes the lever 24 to pivot about the axis 25 and thus causes close contact of the motor pulley 20 with the tangential belt 21. As the pulley 20 is thus caused to rotate, the bosses 11, 12 and 13 are also driven by the ridged belt 22.

Conversely, when it is desired to disengage the spindle, it suffices to pull the rod 28 in the direction of the arrow F2, which moves the motor pulley 20 away from the belt 21 and consequently causes the rotation of the bosses 11, 12 and 13, and hence of the discs 14, to stop.

As shown in FIG. 3, the motor pulley 20 can be located above or below the platen 10, which makes it possible to utilize the spindle, relative to the other members present in the path of the yarn, regardless of the direction of travel of the yarn in the spindle.

Equally, the motor pulley 20 can be mounted in the reverse position relative to the tangential belt 21 (as represented by the dot-and-dash lines in FIGS. 2 and 3). In this way, the direction of rotation of the bosses 11, 12 and 13 is reversed, while the direction of travel of the tangential belt 21 remains unchanged. In this case, the spindle is engaged in the direction of the arrow F2 and disengaged in the direction of the arrow F1. The arrangement, in which the pulley 20 is on the same side of the belt 21 as the pivot axle 25, is advantageous for obtaining, with the same spindle, a twisting torque acting on the yarn in the opposite direction to that of the preceding assembly.

The spindle according to the invention exhibits numerous advantages compared to the spindles available on the market hitherto. In particular, the fixed position for the travel of the yarn, regardless of the position of the spindle on the machine, obviates the necessity to add counter-pulleys behind the belt opposite each spindle. The fact that only a lightweight member is shifted in order to produce engagement on the tangential belt makes it possible to produce a much simpler mechanical assembly. Also, the fact that the spindle assembly is fixed, which leads to a substantial reduction in vibrations and hence to better yarn quality, provides better uniformity of twist and of wear, and less noise. In addition, the spindle is much more easily incorporated relative to the other members in the path of the yarn, resulting in greater uniformity of the yarns treated on adjacent stations. Finally, the cost of the assembly is reduced.

It is also to be noted that yarns with S-twists and Z-twists can be produced on the same machine without shifting the spindle; and as already stated, this spindle can be used successfully for the false twist texturizing of synthetic yarns, particularly at high speed.

The foregoing description of the invention has been directed to a particular preferred embodiment for purposes of explanation and illustration. It will be apparent, however, to those skilled in this art that many modifications and changes in both apparatus and method may be made without departing from the scope and spirit of the invention. For example, instead of being vertical, a spindle in accordance said the instant invention can be positioned horizontally or at an angle. This and other modifications of the invention will be apparent to those skilled in this art. It is the intention in the following claims to cover all such equivalent modifications and variations as fall within the true spirit and scope of the invention.

What is claimed is:

1. In a spindle adapted for use on a false twist texturizing machine which comprises a fixed platen disposed adjacent a tangential belt, a motor pulley mounted on an axle substantially perpendicular to the platen for rotation upon engagement with the tangential belt, three bosses mounted on the platen parallel to the motor pulley, each boss carrying at least one friction disc rotatable thereon in response to rotation of the motor pulley, the improvement comprising:

a lever pivotally attached to said platen, having said motor pulley mounted thereon, and means for pivoting said lever to cause engagement or disengagement of said motor pulley with said tangential belt.

2. A spindle according to claim 1, wherein the motor pulley is located above the platen.

3. A spindle according to claim 1, wherein the motor pulley is located below the platen.

4. A spindle according to claim 1, wherein said means for pivoting the lever comprises a rod extending substantially parallel to the plane of the platen, the end of the said rod having a drive dog thereon which moves in a slot machined in the end of the lever.

5. A spindle according to claim 1, wherein the motor pulley is located on the side of the tangential belt opposite said motor pulley.

6. A spindle according to claim 1, wherein said lever pivots about an axle firmly fixed to the platen.

7. A spindle according to claim 6, wherein the motor pulley is mounted on the lever on the same side of the tangential belt as the pivot axle.

* * * * *